United States Patent [19]

Brodie et al.

[11] Patent Number: 5,052,947

[45] Date of Patent: Oct. 1, 1991

[54] CABLE SHIELD TERMINATION BACKSHELL

[75] Inventors: Benjamin E. Brodie, Seattle; Donald W. Fitzwater, Renton, both of Wash.

[73] Assignee: United States of America as Represented by the Secretary of the Air Force, Washington, D.C.

[21] Appl. No.: 617,706

[22] Filed: Nov. 26, 1990

[51] Int. Cl.[5] ..... H01R 13/648

[52] U.S. Cl. ..... 439/607; 439/578

[58] Field of Search ..... 439/607-610, 439/578-580, 932

[56] References Cited

U.S. PATENT DOCUMENTS

| | | | |
|---|---|---|---|
| 3,110,756 | 11/1960 | Genung et al. | 174/89 |
| 3,280,246 | 2/1965 | Lawson et al. | 174/88 |
| 3,307,137 | 5/1965 | Tordoff et al. | 339/61 |
| 3,435,126 | 1/1967 | Hamilton | 174/78 |
| 3,944,317 | 3/1976 | Oberdiear | 439/610 |
| 3,990,765 | 11/1976 | Hill | 439/580 |
| 3,992,773 | 11/1976 | Duffner et al. | 29/628 |
| 4,382,653 | 5/1983 | Blanchard | 439/610 |
| 4,531,805 | 7/1985 | Werth | 439/578 |
| 4,579,415 | 4/1986 | Van Brunt et al. | 439/578 |
| 4,693,323 | 9/1987 | Owensby | 174/35 |

*Primary Examiner*—Larry I. Schwartz
*Assistant Examiner*—Ken Vu
*Attorney, Agent, or Firm*—Stanton E. Collier; Donald J. Singer

[57] ABSTRACT

The cable shield termination backshell connects to a shielded cable having individually shielded conductors to prevent electromagnetic interference and electromagnetic pulses (EMI/EMP) from entering therein. The backshell has a groove thereabout having a plurality of holes therethrough. The individual braid ends, pigtails, are passed through the holes. An appropriate ring is placed over the groove and the braid ends and compressed thereon. The braid ends remaining exposed are cut off. The outer braid on the cable is attached to the end of the backshell with a ring and then the overall backshell is covered by a boot.

4 Claims, 1 Drawing Sheet

CABLE SHIELD TERMINATION BACKSHELL

STATEMENT OF GOVERNMENT INTEREST

The invention described herein may be manufactured and used by or for the Government for governmental purposes without the payment of any royalty thereon.

BACKGROUND OF THE INVENTION

The present invention relates to electrical cables, and, in particular, to the shielding of electrical cables at the termination thereof, and, more particularly, to shielding of electrical cables from electromagnetic interference and electromagnetic pulses (EMI/EMP) from entering therein.

One method of shielding is that used in coaxial cables having one main conductor therein separated from the outer tube wall by dielectric material The outer tube wall is covered by a metal braid being tube shaped and has a further protective coating of rubber thereabout, for example. The metal braid is exposed and the cable itself is placed through a clamp nut. The braid is pulled back against the clamp nut and then a metal ferrule is placed on the dielectric core clamping the metal braid to the clamp nut. A connector body is then placed over the ferrule and threaded onto the clamp nut thereby totally securing the coaxial cable end. The device is clearly appropriate for coaxial cables having a single conductor therein but would be difficult to apply if multiple conductors are therein. See U.S. Pat. No. 3,110,756, for example.

Another prior method of shielding of a cable having multiple conductors therein with a metal braid thereabout uses magnetic pulse forming apparatus to securely clamp the cable to an appropriate fitting. The metal braid at the cut end is placed about a ring which is inserted into a shell having appropriate sized ends. The magnetic pulse forming apparatus compresses the shell and ring about the cable to make a secure fitting. See U.S. Pat. No. 3,992,773 which is incorporated by reference.

U.S. Pat. No. 3,280,246 discloses a cable having a multitude of conductors with metal braid about each. The braid of each conductor is removed to a short distance of the cut ends and is secured in between the metal rings uniformly about the rings. The above patent is incorporated by reference.

A method of grounding the metal braid of the cable is shown in U.S. Patent which is also incorporated by reference.

As seen from the above, there is a need to be able to connect each metal braid to the backshell to provide proper EMP shielding.

SUMMARY OF THE INVENTION

The present invention connects a shielded cable having individually shielded conductors to a fitting which is commonly called a backshell. The backshell has a groove thereabout having a plurality of holes therethrough. The individual braid ends, pigtails, are passed through the holes. An appropriate ring is placed over the groove and compressed thereon. The braid ends remaining exposed are cut off. The outer braid on the cable is attached to the end of the backshell with a ring and then the overall fitting is covered by a boot.

One object of the present invention is to provide a fitting protected from EMI/ EMP.

Another object of the present invention is to provide a fitting that has a cable attached thereto with an exterior braid shield wherein each conductor has a braid shield also.

These and many other objects and advantages of the present invention will be readily apparent to one skilled in the pertinent art from the following detailed description of a preferred embodiment of the invention and the related drawings.

DESCRIPTION OF THE PREFERRED EMBODIMENT

Figure 1:
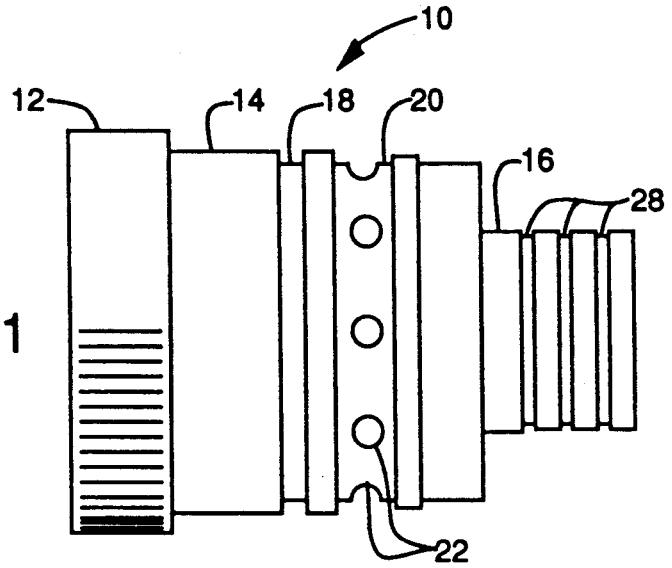
FIG. 1 is a side view of the backshell of the present invention.

Referring to FIG. 1, a backshell 10 is shown therein having a threaded connecting sleeve 12 rotatably connected onto a first housing 14 in a conventional manner. A second housing 16 is an integral part of the first housing 14. Both housings 14 and 16 are of a cylindrical shape and made of a metal such as aluminum. The first housing 14 has a boot groove 18 thereabout and a braid end groove 20 thereabout. The braid end groove 20 has a multitude of holes 22 sufficient in number to accommodate the number of individually shielded conductors 24 of a shielded cable 26, FIG. 2. The second housing 16 has means for allowing attachment of the cable 26 being a multitude of grooves 28, for example.

Figure 2:
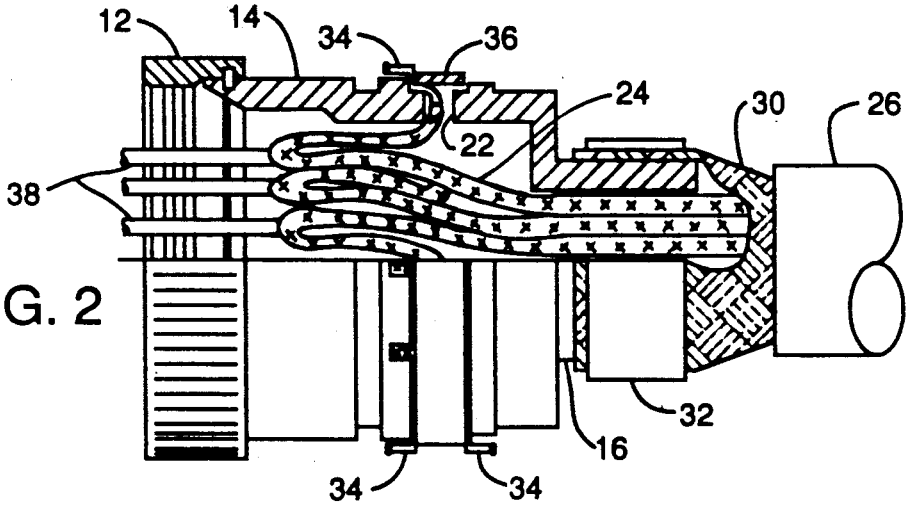
FIG. 2 is a side view of the backshell with a partial cross section of the present invention with a shielded cable connected thereto.

In FIG. 2, a braid shield 30 of the cable 26 is placed over the second housing 16 and a shield termination ring 32 being either a crimp ring, magneform ring, nitonal band or band clamp is placed thereabout and secured by the appropriate means.

The shielded conductors 24 are placed inside the first housing 14 where the metal braid is partially pulled back to form a pigtail having a braid end 34 which is placed through one hole 22. Each braid end 34 is so placed about the first housing in a uniform manner. After this an internal shield termination ring 36 being of a width slightly less than that of the groove 20 is attached thereon. Internal shield termination ring 36 is of the same general nature as ring 32. After being attached, any excess shield ends 34 are trimmed away. The shield ends 34 may exit from either side of the ring 34. The conductors 38 of the shielded conductors are attached in a conventional manner to either male or female pins, as appropriate, not shown.

Figure 3:
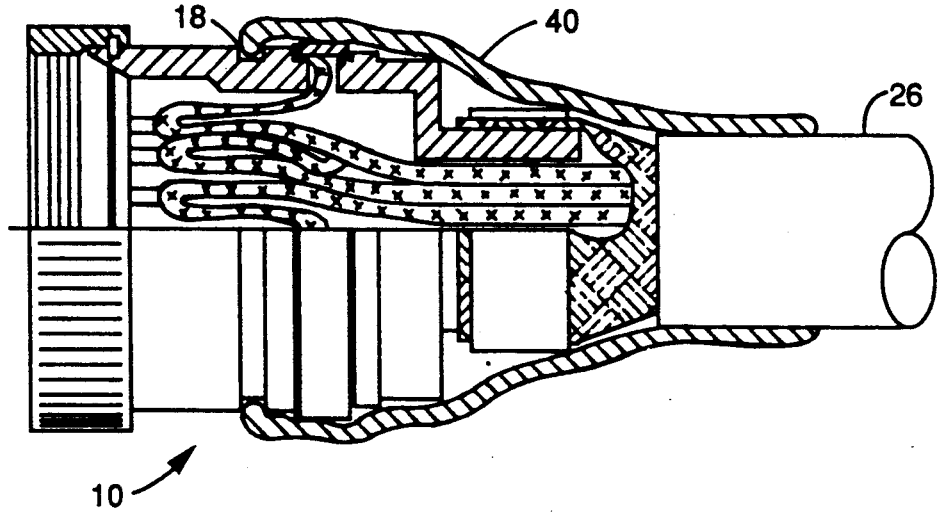
FIG. 3 is a side view of the FIG. 2 including an environmental boot thereabout.

In FIG. 3, a heat-shrink boot 40 is placed on the backshell 10 for environmental protection Clearly, many modifications and variations of the present invention are possible in light of the above teachings and it is therefore understood, that within the inventive scope of the inventive concept, the invention may be practiced otherwise than specifically claimed.

What is claimed is:

1. A cable shield termination backshell for connecting to a shielded cable having at least one shielded conductor therein, said cable shield termination backshell comprising:

a first housing, said first housing having a braid end groove on an exterior surface thereabout, said groove having at least one hole therethrough;

a second housing, said second housing being an integral part of said first housing, said second housing having thereon means for connecting to the shielded cable;

a connecting sleeve, said connecting sleeve rotatably connected to said first housing on an end opposite to said second housing;

means for providing electrical connections, said means for providing electrical connection being located in the end of said first housing with said sleeve thereabout;

an internal shield termination ring, said internal shield termination ring being located in said braid end groove; and a cable shield termination ring, said cable shield termination ring being located about said second housing to secure the cable shield thereto;

whereby the shielded conductors enter into the first housing, the shield about each conductor being partially removed to expose a conductor, the removed shield being formed into a pigtail braid end, each braid end being placed through the holes in the braid end groove and secured thereon by said internal shield termination ring, the exposed conductor being connected to said means for providing electrical connections.

2. A cable shield termination backshell as defined in claim 1 wherein said holes in said braid end groove are uniformly distributed about said braid end groove

3. A cable shield termination backshell as defined in claim 1 wherein said first housing further includes a boot groove thereabout.

4. A cable shield termination backshell as defined in claim 3 wherein said boot is placed partially about said first and said second housings to prevent environmental contamination, said boot covering said internal shield termination ring.

* * * * *